US006276488B1

(12) United States Patent
Divine et al.

(10) Patent No.: US 6,276,488 B1
(45) Date of Patent: Aug. 21, 2001

(54) CRANE EXTENSION SYSTEM

(75) Inventors: Thomas C. Divine, Pickerington; John K. Ruckman, Mt. Vernon, both of OH (US)

(73) Assignee: T & M Associates, Columbus, OH (US)

( * ) Notice: Subject to any disclaimer, the term of this patent is extended or adjusted under 35 U.S.C. 154(b) by 0 days.

(21) Appl. No.: 09/282,298

(22) Filed: Mar. 31, 1999

(51) Int. Cl.[7] ..... E04G 3/00
(52) U.S. Cl. ..... 182/2.11; 182/69.4
(58) Field of Search ..... 182/2.1–2.9, 2.11, 182/69.4

(56) References Cited

U.S. PATENT DOCUMENTS

| | | | | |
|---|---|---|---|---|
| 3,146,853 | * | 9/1964 | Eckels | 182/2.4 |
| 3,695,390 | * | 10/1972 | Leigh | 182/2.11 |
| 3,841,436 | * | 10/1974 | Grove | 182/2.11 |
| 4,314,622 | * | 2/1982 | Lindquist | 182/2.11 |
| 5,269,393 | * | 12/1993 | Luscombe | 182/2.3 |
| 5,727,645 | * | 3/1998 | Woodling | 182/2.11 |

* cited by examiner

*Primary Examiner*—Alvin Chin-Shue

(74) *Attorney, Agent, or Firm*—Kremblas, Foster, Phillips & Pollick

(57) ABSTRACT

A crane extension system is provided for use with a crane having a boom, the improvement having a mounting platform assembly and a mounting basket, with the mounting basket secured to the mounting bracket assembly. The mounting platform assembly is secured to the crane, and includes a mounting plate attached to the crane and a mounting platform, with the mounting platform being attached to the mounting plate and having a mounting platform plate, a mounting bracket, and an adjustable bracket portion for adjusting the position of a mounting basket. Additionally, the mounting platform has a mounting platform base, with the mounting platform base secured to the mounting platform plate. The adjustable bracket portion is also secured to the mounting platform base. The adjustable bracket portion has a bracket base, a pair of threaded rods passing through the bracket base, fasteners securing the position of the bracket base on the rods, and an engagement portion which contacts and provides for attachment of the mounting platform to the mounting basket. Still further, the system can include a first boom extension segment and a second boom extension segment, with the first boom extension segment being secured to the crane, and the second boom extension segment being secured to the first boom extension segment. The first boom extension segment comprises a cylindrical portion and a rectangular portion, with the rectangular portion being secured to the crane.

17 Claims, 7 Drawing Sheets

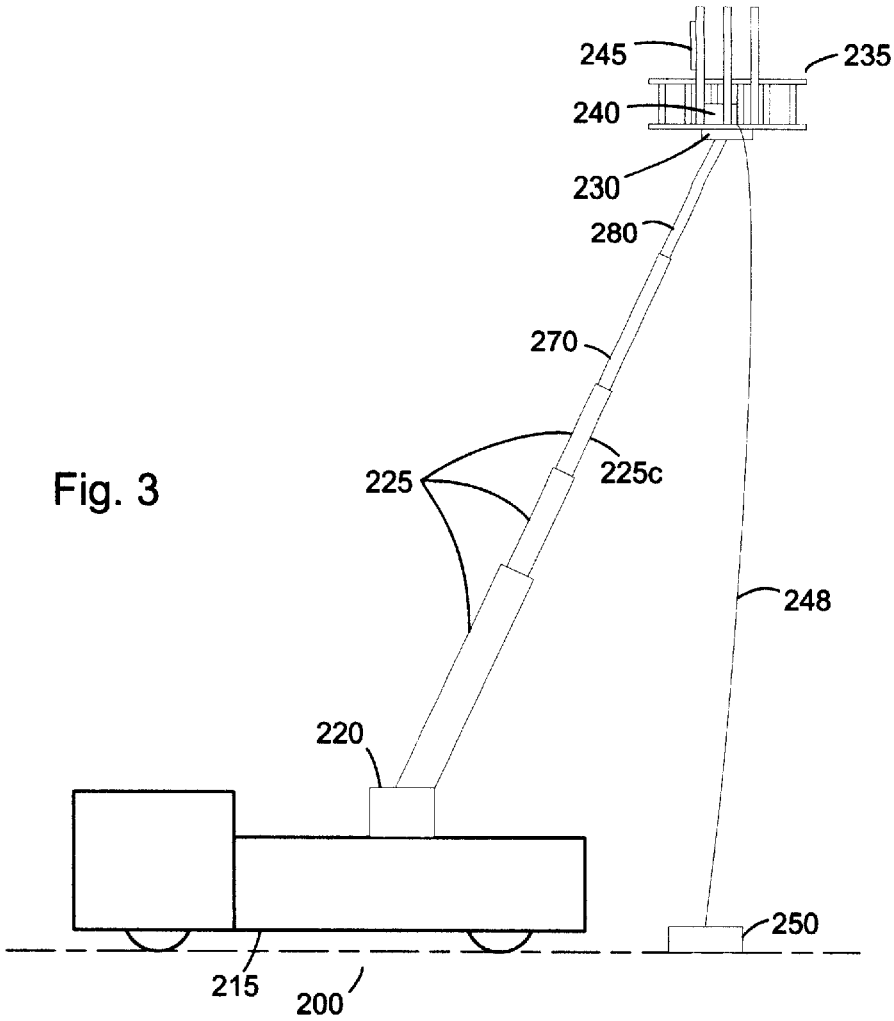
Fig. 3
Fig. 4
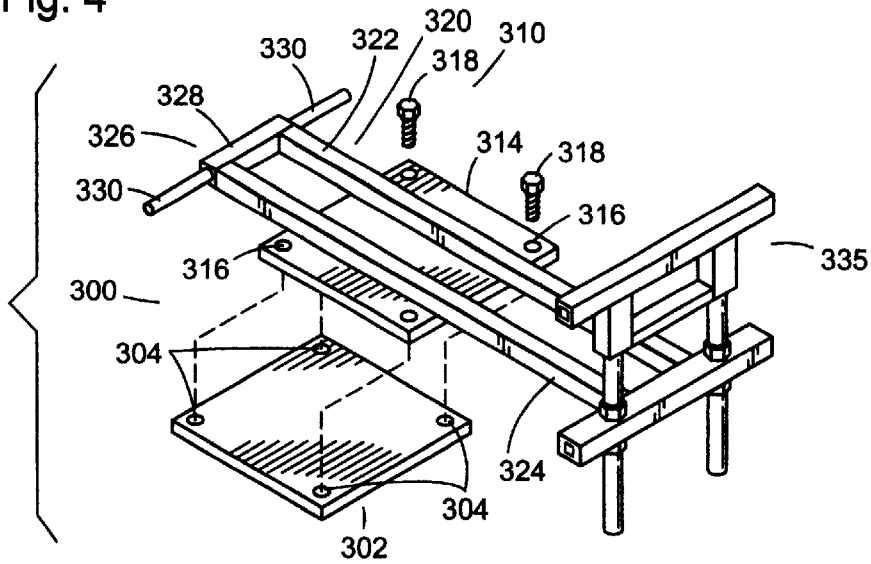

CRANE EXTENSION SYSTEM

BACKGROUND OF THE INVENTION

1. Field of the Invention

The present invention relates generally to cranes, and more particularly to a system which extends the effective height of a crane, and even more particularly to a system which can be used in the conducting of RF drive tests.

2. Description of Related Art

With the proliferation of radio frequency transmissions, particularly in conjunction with the ever increasing use of cellular telephones, optimization of the geographical placement of cellular towers with their attendant antennas has become very important. To confirm the correctness of the location of the tower, before the tower is actually erected in place, a testing of the proposed location is conducted due to the costs involved in the tower's erection and the potential misallocated costs involved if the geographical placement is either unacceptable or demonstrably less than desirable.

This testing commonly takes the form of a RF drive test, also referred to as just a drive test, wherein a signal from the location of the proposed tower is emitted and then received on the ground by equipment in a vehicle, with the vehicle being driven around the vicinity of the proposed tower location in order to pinpoint where the transmitted signal can actually be picked up.

The situation is made more complicated by the fact that there are two type of antennas. The first type of antenna used in this type of transmission system is an omni antenna. The signal emitted by this type of antenna goes out relatively uniformly in all directions, similar to the waveform created when a pebble is tossed into a pond. The second type of antenna used in this type of transmission system is a directional antenna. With a directional antenna, a frequency can be emitted in a certain direction. This type of antenna is sometimes desirable because buildings, trees, or even the terrain can affect the ability to receive a signal.

For example, because of congestion, police radios or whatever may want to make use of directional antennas to transmit from tower to tower to tower with the ultimate goal being that the signal can be received and effectively transmitted from an omni antenna. By way of another example, if the proposed tower location is on top of a big hill with the desired coverage area being around the hill, then an omni antenna is fine. However, if you have a building adjacent the proposed tower location, then you are not going to benefit from using an omni directional antenna. In fact, it is more desirable to transmit away from the building and avoid interference. In such cases a directional antenna is preferred. Directional antennas are also used where the tower takes the form of a water tower, such that a plurality of antennas are spaced on the curved side of the water tower. When a proposed site destined for a directional antenna is tested, the test is conducted with a directional antenna, not an omni.

Crane systems have been used to simulate the existence of a tower, thereby permitting a drive test to be conducted without going to the time and expense of erecting a permanent tower. These systems use a 10' wide truck that in total weighs 140,000 pounds. While the truck and crane itself only weighs 60,000–80,000 pounds, by the time the counter weights, mounting basket, and additional test equipment are added, it weighs up to 140,000 pounds. Typically, another semi with nothing but the counter weights and rigging is used.

Drive tests often need to be conducted at heights of between 150 and 200 feet, which to date has required the use of trucks which need permits due to the size of trucks used in conjunction with the necessary cranes, which in the prior art have normally been of the lattice type. Trucks which need permits can only be moved between the hours 7:00 a.m. and 6:00 p.m. or during daylight hours. Additionally, they are not allowed to run on Sundays. Plus, it usually takes 24 hours to get a permit.

Because the size of the truck used in the prior art is 10' wide, it requires a runner truck, and needs to be labeled "WIDE LOAD" with the accompanying flags. With a truck that big there can be problems. Just getting back to where the test is to be run, one wrong turn and what was a 8' drive becomes a 15' wide path. Additionally, extra space is needed once the crane truck is in position: extensions have to be put out so that the truck doesn't tip over. Thus with the prior art, each of the outriggers add another 10–15' to the width of the entire project.

Additionally, the typical prior art crane system has its drawbacks. For example, there can be interference from an omni antenna because of the existence of the crane on one of the sides. The advantage of the relatively smaller trucks is that they do not require permits, nor take up as much space, however, they heretofore have been unable to reach the heights necessary to conduct drive tests. Plus, typically two trucks are needed, due to the counter weights, and the size and weight of the boom sections. Also, the fact that only a certain height can be reached with the 38, 30 and 23.5 ton extendable boom cranes, if greater heights than 150' are required, then a bigger boom or bigger crane, such as a lattice type crane, is needed which translates, as has been discussed above, into more set up area, more set up time, the obtaining of permits, more cost, and at least two men to do it. For example, in order to conduct a drive test at the 200' level, the crane must be heavier than a 30 ton unit.

It is thus apparent that the need exists for a device or system that can extend the effective height of a crane which overcomes the problems associated with the prior art. Such a or system should be capable of being used with various brands of cranes.

BRIEF SUMMARY OF THE INVENTION

There is disclosed a crane extension system for use with a crane having a boom, the improvement having a mounting platform assembly and a mounting basket, with the mounting basket secured to the mounting bracket assembly. The mounting platform assembly is secured to the crane, with the mounting platform assembly having a mounting plate attached to the crane, and a mounting platform, and with the mounting platform being attached to the mounting plate and having a mounting platform plate, a mounting bracket, and an adjustable bracket portion for adjusting the position of a mounting basket.

Additionally, the mounting platform has a mounting platform base, with the mounting platform base secured to the mounting platform plate. The adjustable bracket portion is also secured to the mounting platform base. The adjustable bracket portion has a bracket base, a pair of threaded rods passing through the bracket base, fasteners securing the position of the bracket base on the rods, and an engagement portion, with the engagement portion contacting and providing for attachment of the mounting platform to the mounting basket.

Still further, the system can include a first boom extension segment and a second boom extension segment, with the first boom extension segment being secured to the crane, and the second boom extension segment being secured to the first boom extension segment. The first boom extension segment comprises a cylindrical portion and a rectangular portion, with the rectangular portion being secured to the crane. Preferably, the crane is an extendable boom crane.

There is also disclosed a crane extension system for use with a crane having a boom, the improvement comprising a mounting platform assembly, a mounting basket, a first boom extension segment, and a second boom extension segment, wherein the mounting platform assembly is secured to the crane, with the mounting platform assembly having a mounting plate attached to the crane and a mounting platform, with the mounting platform attached to the mounting plate and having a mounting platform plate, a mounting bracket, and an adjustable bracket portion for adjusting the position of a mounting basket, with the mounting basket being secured to the mounting bracket assembly. The first boom extension segment is secured to the crane, and the second boom extension segment is secured to the first boom extension segment.

Additionally, the mounting platform has a mounting platform base, with the mounting platform base secured to the mounting platform plate. The adjustable bracket portion is also secured to the mounting platform base. The adjustable bracket portion has a bracket base, a pair of threaded rods passing through the bracket base, fasteners securing the position of the bracket base on the rods, and an engagement portion, with the engagement portion contacting and providing for attachment of the mounting platform to the mounting basket. Still further, the first boom extension segment has a cylindrical portion and a rectangular portion, with the rectangular portion being secured to the crane. Preferably, the crane is an extendable boom crane.

There is also disclosed a crane extension system for use with a crane having a boom, the improvement having a mounting platform assembly secured to the crane, with the mounting platform assembly having a mounting plate attached to the crane and a mounting platform, with the mounting platform attached to the mounting plate and having a mounting platform plate, a mounting bracket, and an adjustable bracket portion for adjusting the position of a mounting basket, with the mounting platform having a mounting platform base, with the mounting platform base secured to the mounting platform plate, with the adjustable bracket portion having a bracket base, a pair of threaded rods passing through the bracket base, fasteners securing the position of the bracket base on the rods, and an engagement portion, with the engagement portion contacting and providing for attachment of the mounting platform to the mounting basket, with the adjustable bracket portion secured to the mounting platform base, and a mounting basket, with the mounting basket secured to the mounting bracket assembly.

Additionally, the system includes a first boom extension segment and a second boom extension segment, with the first boom extension segment being secured to the crane, and the second boom extension segment being secured to the first boom extension segment. The first boom extension segment has a cylindrical portion and a rectangular portion, with the rectangular portion being secured to the crane. Preferably, the crane is an extendable boom crane.

One objective of this invention is to provide a crane extension system that will enable smaller cranes to be used in the conducting of RF drive tests.

Another objective of this invention is to provide a crane extension system that will permit smaller cranes to be used for the positioning of platforms at heights herebefore incapable of attainment with these types of cranes.

Other aspects and advantages of the instant invention will be appreciated from the following description, drawings, and the appended claims.

BRIEF DESCRIPTION OF THE DRAWINGS

FIG. 3 discloses a modified embodiment of the invention.

FIG. 4 discloses the mounting platform assembly of the invention.

DETAILED DESCRIPTION OF THE INVENTION

Figure 1:
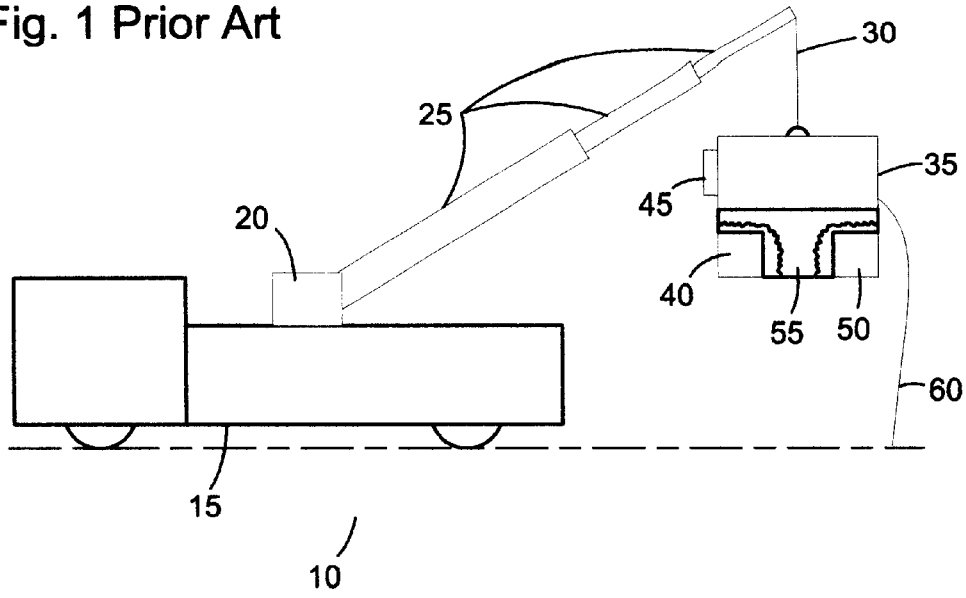
Fig. 1 Prior Art
FIG. 1 discloses the prior art associated with the application of this invention.

Having reference to the drawings, attention is directed first to FIG. 1 which shows a very general side view of the prior art designated generally by the numeral 10. The apparatus generally employed to simulate the placement of a tower typically makes use of a truck 15 having a crane 20 thereon. The crane typically uses a plurality of boom extensions 25 as well as cable 30. If an extendable boom crane is used the boom extension sections 25 are assembled in accordance with standard practice in the trade, and the cable 30 is installed in its normal operative position. For drive tests requiring high heights, a lattice type crane typically is used.

From this cable 30, hangs a cage or enclosed platform 35. Typically the transmitting equipment 40 is placed on the floor of the cage and secured to the basket's 35 structure, as is the RF antenna 45 used to conduct this particular drive test. Also secured to the basket 35 typically in the prior art is the power source 50 which often takes the form of a gasoline powered generator. As mentioned before, the power source 50 as well as the transmitter 40 are secured to the structure of the cage with the detachable securing of these devices being made to the side wall 55 of the basket 35. Finally, to prevent the basket from spinning or otherwise swaying as it hangs suspended from the crane, a rope or cable 60 typically is dropped from the basket to the ground.

In actual use, the various items needed are secured to the basket and then the basket elevated to the desired position. If a generator is used as a power source and its fuel becomes exhausted, it is necessary to stop the test and lower the basket, refill the generator, raise the basket, and then continue the test. It should also be appreciated that due to the size of crane that is needed in the prior art, two individuals at least are needed to accompany and participate in the testing process.

Figure 2:
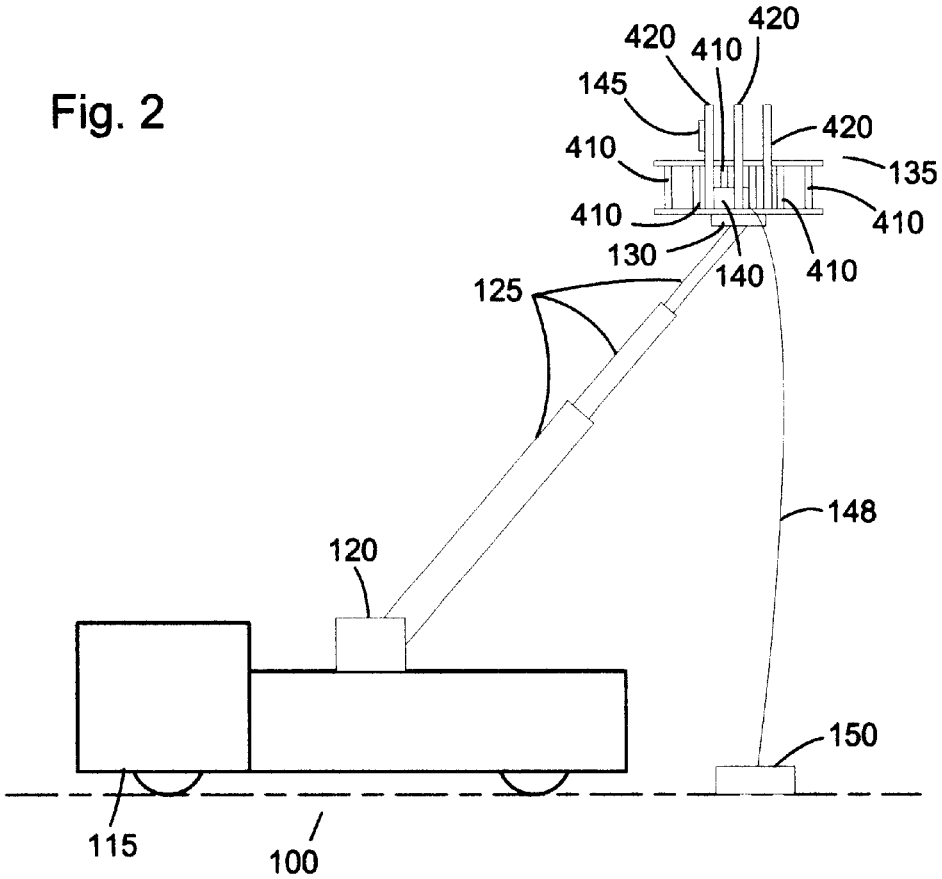
FIG. 2 discloses an embodiment of the invention.
Figure 5:
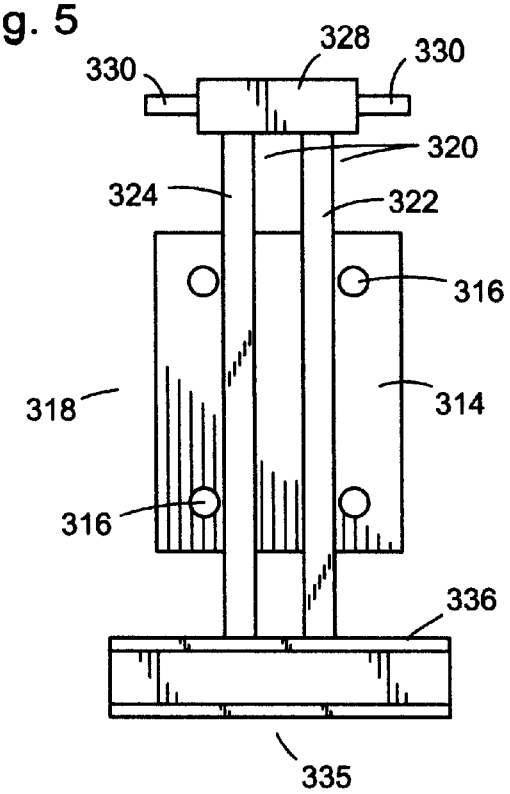
FIG. 5 discloses a top planned view of the mounting platform.
Figure 6:
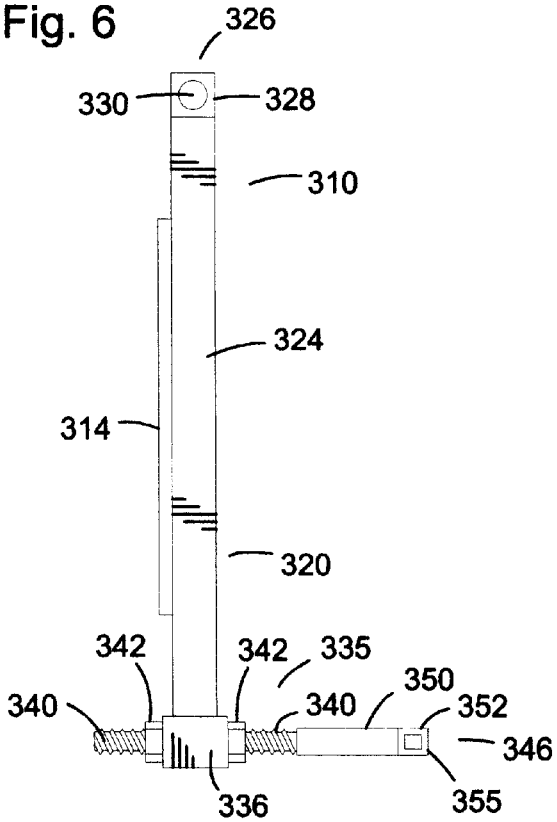
FIG. 6 discloses a side elevational view of the mounting platform taken from the left side of FIG. 5.
Figure 7:
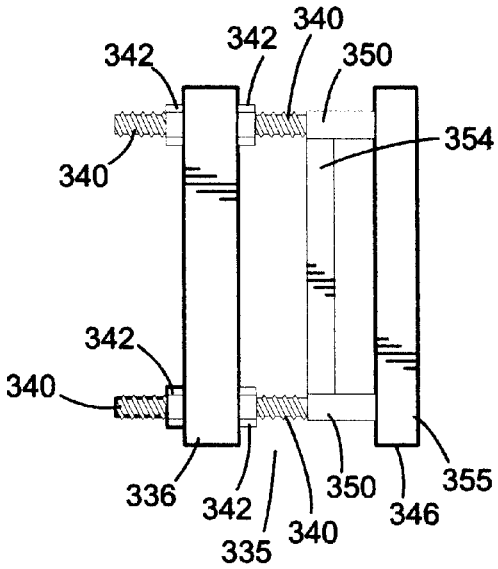
FIG. 7 discloses a plan view of the adjustable bracket portion of the invention taken from the bottom of FIG. 6.

Turning now to FIG. 2, the crane extension system of this invention is generally disclosed, being referenced by the numeral 103. As with the prior art, a truck 115 is involved, however, the size of crane 120 is significantly less than the size needed in the prior art, and consequently, the size of truck needed is significantly smaller. As with the prior art, a plurality of booms and boom extensions 125 can be used, however, instead of requiring a cable as in the prior art, the system of this invention makes use of a unique platform mount 130, atop which platform mount 130, a unique basket 135 weighing about 35 pounds is secured. In the basket 135 is the standard transmitter 140, and secured to the basket is the antenna 145 used in the conducting of the test. In accordance with the preferred embodiment of the invention an electrical cable 148 is dropped from the basket 135 and connects the transmitter 140 with a power source 150, with the power source 150 being basically at ground level, either physically on the ground as shown or on the truck.

A slightly modified embodiment of the invention is shown in FIG. 3. Many of the components of the system shown in FIG. 3 are the same as those shown in FIG. 2, with a couple of notable exceptions. Therefore, it can be appreciated that this modified system 200 once again makes use of a truck 215, a crane 220, a plurality of standard boom extensions 225, the mounting platform 230, the basket 235, the transmitter 240, the antenna 245, the electrical cable or wiring 248, and a power source 250. Additionally, this modified embodiment of the system includes a first boom extension 270 and a second boom extension 280, both of which have a unique structure with the first boom extension segment 270 being connected to the distal boom extension 225*c* and the second boom extension segment 280 having its opposite ends connected to the first boom extension segment 270 and the mounting platform 230.

The mounting platform assembly 300 associated with this invention can be appreciated through a comparison of FIGS. 4–7. The mounting platform assembly 300 is comprised of a steel mounting platform attachment plate 302 and a mounting platform 310 which are secured to one another by fasteners 318. These fasteners 318 extend through apertures 304 in the mounting platform attachment plate and apertures 316 in the mounting platform plate 314 associated with the mounting platform 310, which platform plate 314 can be fabricated from aluminum. The apertures have a diameter of 7/16" and are spaced 5 3/16" apart width wise and 8 15/16" apart length wise. Both the mounting platform attachment plate and the mounting platform plate 302 and 314 respectively are approximately 8" wide by 12" long, and of a 1/8" thickness. The mounting platform attachment plate 302 is secured to the distal end of the boom by welding, and in the prior art has been used to secure thereto the pulley associated with the cable of the crane.

In addition to the mounting platform plate, the mounting platform 310 has a mounting platform base 320, which in the preferred embodiment of the invention takes the form of a pair of base cross bars 322, 324. One end of each of the base cross bars are secured to mounting bracket 326. Each of the base cross bars are approximately 22 3/4" in length and are spaced 1 1/2" from each other. They are formed from 1" square steel rods.

The mounting bracket 326 preferably includes a central portion 328 which is 6" long and also formed from 1" square steel tubing. Additionally, there are threaded end portions 330 which are each 3/4" in diameter and 3 1/8" long. The end portions may be fabricated to attach directly to the opposite ends of the central portion 328, however, it would also be possible to insert a 3/4" rod through a hollow 6" square tube, and then secure the rod to the tube, such that the 3 1/8" end portions 330 extend on both sides of the central portion 328.

The mounting platform also comprises an adjustable bracket portion 335 with the adjustable bracket portion 335 having a bracket base 336 preferably formed of 1 1/4" square tubing with one of the surfaces secured by welding or other suitable fastening means to the ends of the mounting platform base 320 at the opposite end from where the mounting bracket 326 is secured. Passing through the bracket base 336 are two threaded rods 340 on which fasteners 342 are preferably placed so as to secure the rod 340 relative to the bracket base 336. These fasteners could take many forms such as standardized nuts, however, it may be desirable to have them take the form of a locking fastener either of a single or cooperating type on each side of the bracket base 336.

One end of the rod 340 is secured to engagement portion 346. Engagement portion 346 preferably has a pair of engagement portion supports 350, one end of which effects securing thereto of the rod 340 and the other end of which is secured by welding or other fastening means to the engagement portion top section 352. The engagement portion top section 352 and the engagement portion supports 350 are shown as being distinct components of the engagement portion 346, however, it would be possible to fabricate the entire engagement portion as a unitary piece with the engagement portion 346 also including an engagement portion cross bar 354.

The engagement portion support 350 is preferably 3" long and formed of 1" square tubing. Similarly, the engagement portion top section 352 is formed of 1" square metal tubing. The engagement portion cross bar is also formed from 1" square metal tubing and is preferably located with its one surface at the juncture of the rod 340 and engagement portion support 350, such that there is 2" of space between the top of the engagement portion cross bar and the lower surface of the engagement portion top section 352. The engagement portion top section is preferably 12" wide and centered atop the engagement portion supports 350 with the engagement portion supports having their innermost surfaces spaced apart a distance of 7". Additionally, it can be appreciated that the length of the rods 340 from their juncture with the engagement portion supports 350 is 7 1/2" with the two rods being spaced apart from their centers a distance of 8". It can thus be appreciated that an engagement surface 355 is provided, such that the basket associated with this invention rests on the engagement surface 355 of the adjustable bracket portion 335 as well as on the mounting bracket 326, as can better be appreciated from the following description of the structure of the basket associated with this invention.

Figure 8:
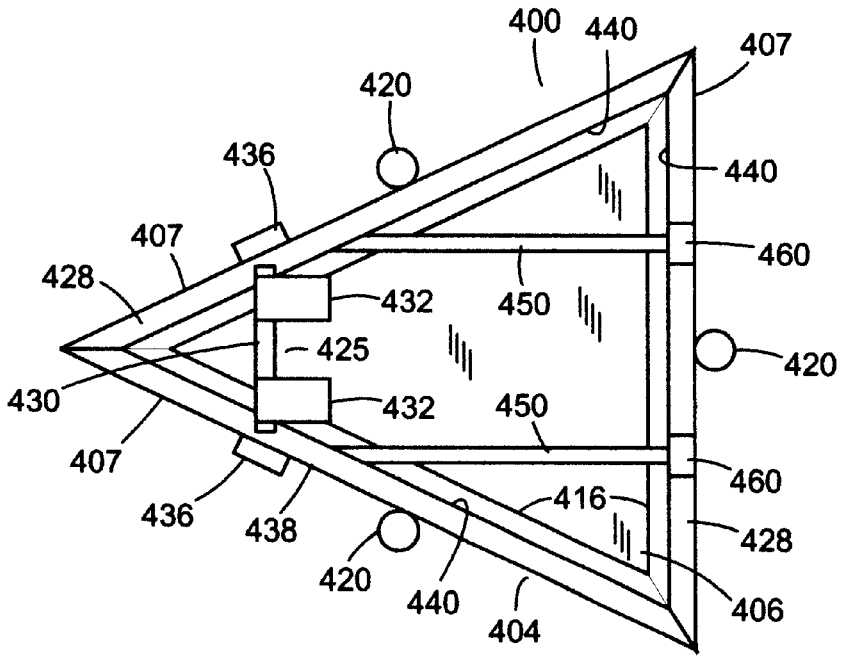
FIG. 8 discloses a bottom plan view of the mounting basket assembly.
Figure 9:
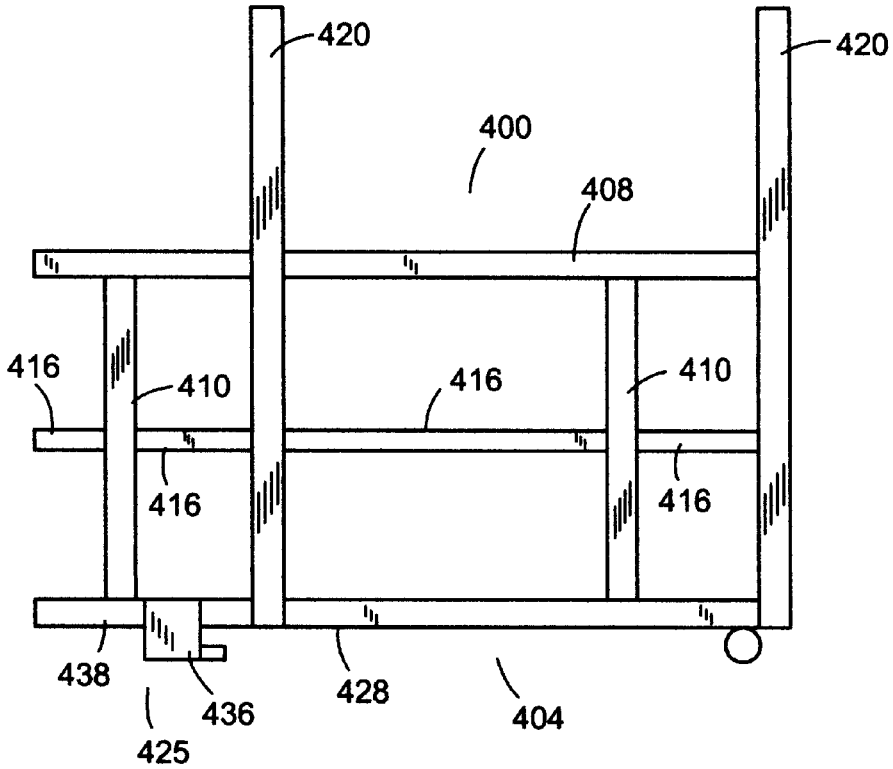
FIG. 9 discloses a side elevational view of the mounting basket assembly.

The next major component of the invention is the mounting basket assembly which can best be appreciated from a comparison of FIGS. 2, 8 and 9, and which is designated generally by the numeral 400. The mounting basket assembly 400 associated with this invention has a base portion 404, with base portion 404 having a base surface 406, preferably formed using mesh decking, such as aluminum mesh, which is welded to the base portion structural supports 407, with the base structural supports 407 associated with this invention being shown as being three in number, such that the general configuration of the mounting basket's base portion is that of an equilateral triangle. With this geometric configuration, it resembles a cellular tower. However, obviously other geometric configurations for the shape of the base for the mounting basket could exist.

In the preferred embodiment of the invention, the base portion supports 407 are fabricated from 1" square tubing, such that each side wall of the triangular base is 42" in length. A side rail portion 408 is located 24" above the base portion supports 407 in superposed relationship. The side rail portion 408 is secured to the base portion supports 407 by side wall uprights 410, with six of these side wall uprights being shown in FIG. 2. Each of these side wall uprights may also be fabricated from 1" square tubing, such as hollow aluminum tubing, with the top and bottom of these uprights being welded or otherwise securely fastened to the side rail portion and base portion supports, respectively.

As shown in FIG. 9, the mounting basket assembly 400 is shown with two of the side wall uprights per side. In addition to the side railing 408, an intermediate railing 416 preferably formed from a ½" solid round metal bar is placed 12" above the base portion supports 407. This bar is secured to the interiorally facing surface portions of each of the side wall uprights 410.

Finally, in the preferred embodiment of the invention there are a plurality of posts 420 which are secured to the mounting basket and extend upwardly above the side rail 408. These posts are located at the mid-point of each of the sides of the mounting basket. In the preferred embodiment of the invention these posts are 66" high, 1⅝" outer diameter aluminum pipe to which the antenna used in the drive test may be secured, such that the post to which the antenna is secured functions as a pipe mount. As shown in a comparison of FIGS. 8 and 9, these posts are secured to the outer surface side rail 408 and base portion support 407 by welding or other suitable means well known in the art of metal fabrication. With three such pipe mounts provided, three separate omni-directional antennas can be held, thus it can be appreciated that the invention permits the creation of the correct azimuth and declination for a test, and can produce an unobstructed radiation pattern.

As can be best appreciated from a comparison of FIGS. 8 and 9, the mounting basket assembly 400 associated with this invention includes a mounting bracket receptacle 425, with the base portion lower surface 428 having secured thereto a receptacle cross bar 430 with the receptacle cross bar being formed from 1" square tubing having its opposite ends contact the base portion lower surface of two of the base portion supports a distance of 9¾" from the end of the two base portion supports so as to form an isosceles triangle, with the receptacle cross bar 430 having its opposite ends cut at an angle such that the length of the side wall closest to the apex of the isosceles triangle formed thereby is 10⅞, with this dimension of the side walls of the receptacle cross being the shorter of the two side wall dimensions. Secured to the lower surface of the receptacle cross bar 430 are a pair of receptacle plates 432 each of which is approximately 3½" long, 2½" wide, and ⅜" thick with the two plates being spaced apart from each other approximately 6¾" and formed of steel. Thus, it can be appreciated that the central portion 328 of the mounting bracket 32S can easily fit between the two receptacle plates 432 when the mounting bracket is placed within the mounting bracket receptacle 425. When so placed, the end portions 330 rest between the receptacle plates 432, receptacle cross bar 430, and the base surface 406.

A pair of end plates 436 approximately 3" in length are secured to the base portion exterior side surface 438 and receptacle cross bar 430. These end plates 436 extend from the upper surface of the base portion supports 407 to the bottom surface of the receptacle plates 432.

Secured to two points along the base portion interior side surface 440 is a base portion cross bar 450. Preferably there are two such base portion cross bars, with these base portion cross bars being formed from 1" square tubing and spaced parallel to one another, separated by a distance of 14½". The length of each of these cross bars is approximately 24⅞, with the one end of each cross bar preferably being secured to the base portion support closely adjacent the receptacle cross bar. It will also be appreciated from a comparison of FIGS. 8 and 9 that cooperative locking portion 460 is provided, with each of these locking portions being fabricated from a 2¼" long piece of 1" outer diameter tubing having an inner diameter of ⅝. The centers of each of the locking portions 460 are preferably spaced 15¼" apart from each other such that the center of each locking portion is approximately 13⅜" from the corner of the base portion support to which it is secured.

Figure 10:
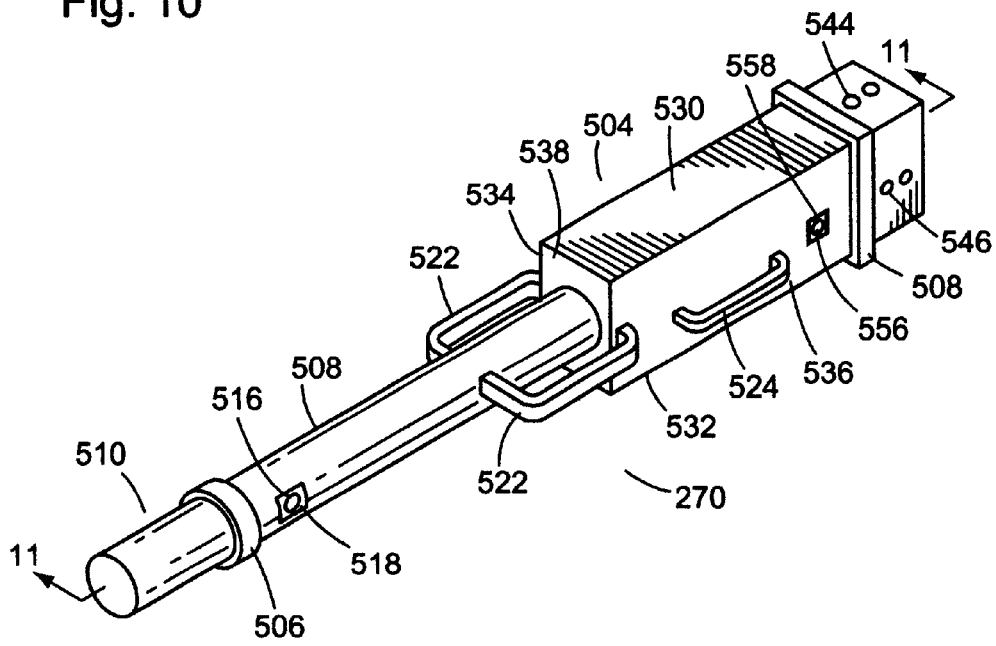
FIG. 10 discloses a perspective view of the first boom extension segment.
Figure 11:
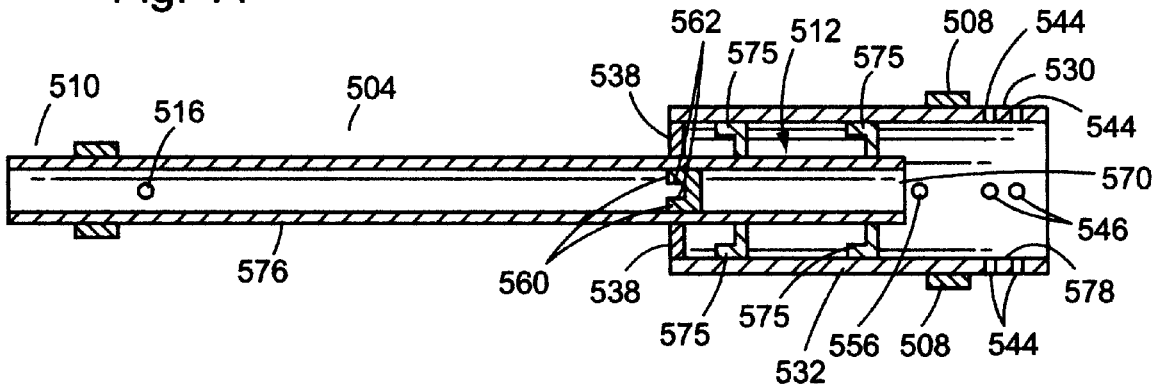
FIG. 11 discloses a vertical sectional view taken along line 11—11 of FIG. 10.

In a modified embodiment of the invention which is disclosed by comparisons of FIGS. 3, 10 and 11, it can be appreciated that the first boom extension segment 270 is shown in greater detail in FIGS. 10 and 11 as being comprised of a cylindrical portion 502 and a rectangular portion 504, with the rectangular portion 504 being secured to the upper most boom extension 225. The readily visible aspects of first boom extension segment include a cylindrical portion reinforcement strap 506, which is formed of steel approximately 3" wide by approximately ½" thick, and a rectangular portion reinforcement strap 508 which is also formed of steel approximately 4" wide and ½" thick. The outer diameter of the cylindrical portion is 10", with the tubing itself being ¼" thick. The cylindrical portion 502 comprises a first end portion 510 which can be appreciated as being relatively free, and a second end portion 512 which, as can be better appreciated from FIG. 11, is fixedly secured to the rectangular portion 504. Associated with the cylindrical portion 502 are a pair of cylindrical portion apertures 516 on opposite sides of the cylindrical portion 502. Associated with each of the two cylindrical portion apertures 516 is a cylindrical portion aperture reinforcing plate 518. Each of the cylindrical portion apertures are 1¹⁄₁₆" in diameter with the cylindrical portion aperture reinforcing plates being 4" square and ½" thick and spaced 18" from the first end portion 510 of the cylindrical portion 502. Also associated with the first boom extension segment are a pair of handles 522 and 524. These handles are preferably fabricated from aluminum pipe and are secured along the first boom extension segment at the balance points for this particular first boom extension segment. As can be seen, handle 522 has one of its ends secured to the cylindrical portion and the other end secured to the rectangular portion, while handle 524 is entirely secured to the rectangular portion 504.

The rectangular portion 504 is comprised of a top panel 530, a bottom panel 532, side panels 534 and 536, respectively, and an end panel 538, which end panel 538 is directly adjacent the top, bottom, and side panels as well as being directly adjacent the outer wall of the cylindrical portion 502. The distance between the open end of the cylindrical portion and the end panel 538 is 8'11⅝. Each of the top and bottom panels are 9½" wide, 7'4¼" in length, and 5/16" thick, with the reinforcing strap being spaced inwardly from the open end of the rectangular portion 24". Also associated with both the top and bottom panels 533 and 532, respectively, are top/bottom panel apertures 544, which are spaced apart a distance of 13⅛.

Each of the side panels 534, 536 are 13½" tall and 7'4¼" long and have a thickness of ½". Also associated with each of the side panels are side panel apertures 546, with these apertures being spaced apart from one another a distance of 9 1/16" from the open end of the rectangular portion and with the aperture nearest the open end of rectangular portion being spaced 3" therefrom. These apertures, as is also the case with the top and bottom panel apertures 544, are 11/16" in diameter. Also associated with the two side panels 534, 536 are rectangular portion apertures 556, one on each of the two side panels, and having associated therewith a rectangular portion aperture reinforcing plate 558. This plate is 4" square and ½" thick with the rectangular portion aperture 556 being 1 1/16" in diameter.

Having reference to FIG. 11, it can be appreciated that the rectangular portion 504 has a section of the cylindrical portion 502 inserted therein. Since the cylindrical portion is 10" in diameter and the width of the rectangular portion is 9½", a portion of the cylindrical side wall is cut off so that the edges 560 fit snugly within the rectangular portion. Additionally, a 6' long and 9" high gusset 570 is inserted into the end of the cylindrical side wall with the cut off portion. This gusset is 5/16" thick and is stitch welded to the interior of the cylindrical portion in 2" welds which occur every 6".

To provide for additional stability of the cylindrical portion within the rectangular portion, a plurality of connecting means 575 are employed. These connecting means secure the exterior surface 576 of the second end portion of the cylindrical portion to the interior surface 578 of the rectangular portion.

Figure 12:
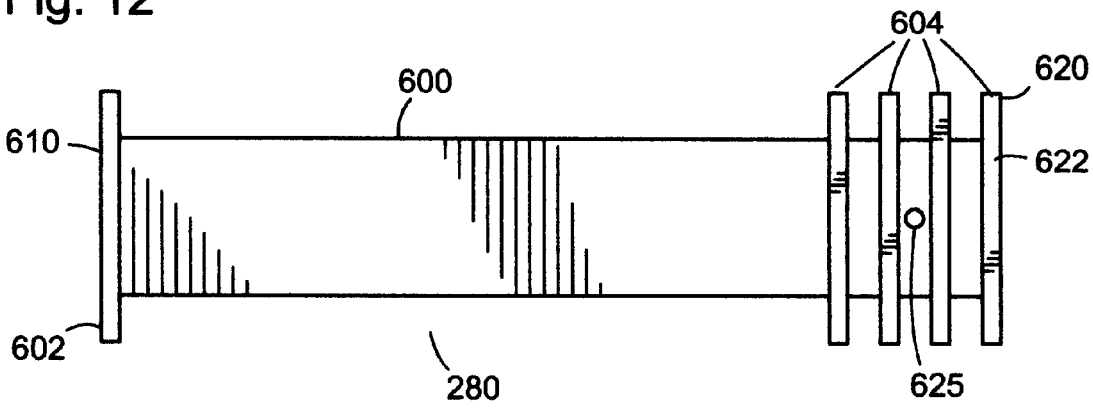
FIG. 12 discloses a side elevational view of the second boom extension segment.

Turning now to FIG. 12, the second boom extension segment 280 is shown with this particular component of the modified embodiment of the invention comprising a central cylindrical portion 600, an end plate 602 welded thereto, and four gussets 604 used to effect a tighter fit within the first boom extension 270 when it is inserted in the first end portion 510 of the cylindrical portion 502 of the first boom extension segment 270. The central portion 600 has an outer diameter of 6¼". The end plate 602 has a height of 12", a width of 8" and is ⅜" thick. The four apertures contained in the end plate are spaced inwardly from the side edges a distance of 1⅛" and from the top and bottom of the plate a distance of 1⅝", such that each of the holes form a corner of a rectangle 5 3/16" in width and 8 13/16" in height. Each of these apertures is 9/16" in diameter. All of the dimensions of plate 602 are incorporated into plate 302.

Figure 13:
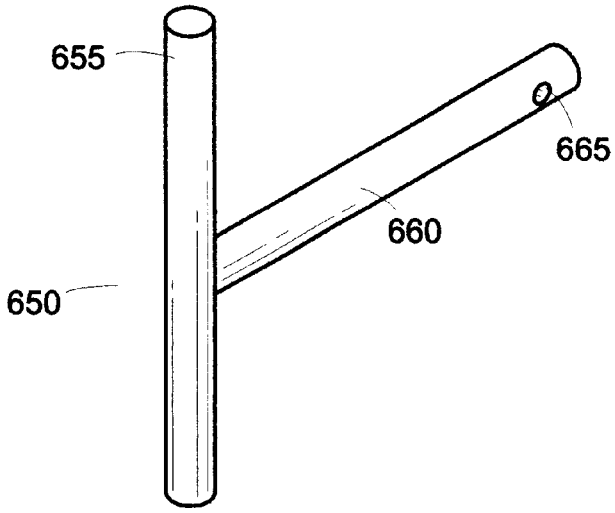
FIG. 13 discloses a perspective view of the first connect pin.

Each of the four gussets 604 are 9½" in outer diameter and ½" thick, being spaced from each other a distance of 12". Thus, the distance from the top surface 610 of the plate 602 to the lower surface 620 of the end gusset 622 is 196⅝". Finally, there is an aperture 625, 17⅞" from the bottom surface 620. This aperture occurs on both sides of the second boom extension segment 280 and is utilized in securing the first and second boom extension segments 270, 280, respectively, to one another. This connection is effectuated by the use of a first connect pin or t-bar 650. This first connect pin 650 is shown in FIG. 13 as having a 6" wide handle formed from a ¾" solid round metal bar to which is welded or otherwise fastened a 12" long piece of ⅝" solid round bar which serves as insert portion 660.

In actual use, the first and second boom extensions segments are aligned such that the first connect pin 650 is passed into aperture 516 which is aligned with aperture 625 such that the insert portion passes completely through both boom extension segments and exits on the opposite side of the cylindrical portion 502 where a suitable fastening means such as a hair or cotter pin is passed through aperture 665 to secure the first connect pin relative to the first and second boom extension segments 270, 28, respectively. This aperture 665 is in the form of a ⅛" hole placed ¾" in from the free end of the insert portion 660.

Figure 17:
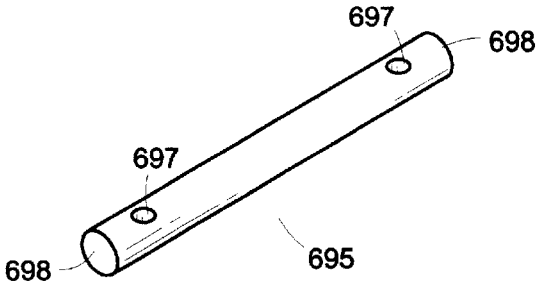
FIG. 17 discloses a perspective view of a mounting basket pin.

Turning now to FIG. 17, there is disclosed a mounting basket pin 695. Near each of its ends 698 are mounting pin apertures 697. In actual use, when the mounting platform has its engagement portion 346 placed adjacent locking portions 460 the mounting basket pin is passed through both cooperative locking portions 460 and the hollow engagement portion and locked in position similar to connect pins 650 and 675 respectively.

In actual use of the modified embodiment of the invention, the first boom extension segment 270 is placed onto the upper-most portion of a standard crane's boom by inserting the end of the crane's boom into the open end of the rectangular portion 504. The crane then has its normal boom attached to the first boom extension segment 270 through the use of four shim plates and a second connect pin or t-bar 675, it being understood that this connect pin is used before the second boom extension 280 is inserted into and connected to the first boom extension segment 270 through the use of the first connect pin 650 discussed above. Once the first boom extension segment is secured to the crane boom, the second boom extension segment is locked in place against the first boom extension by sliding the second t-bar 675 through the cooperating apertures in the two boom extensions. On the distal end of the second t-bar 675 is placed a hair or cotter pin or other appropriate fastener. A washer may be put on the second connect pin 675 adjacent to the hair cotter pin, such that the second connect pin secures the second boom extension segment to the first boom extension segment. The first boom extension segment weighs about 359 pounds, while the second boom extension segment weighs about 150 pounds.

Figure 14:
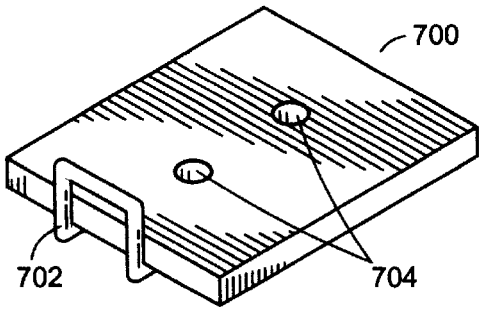
FIG. 14 discloses a perspective view of a first shim plate.
Figure 15:
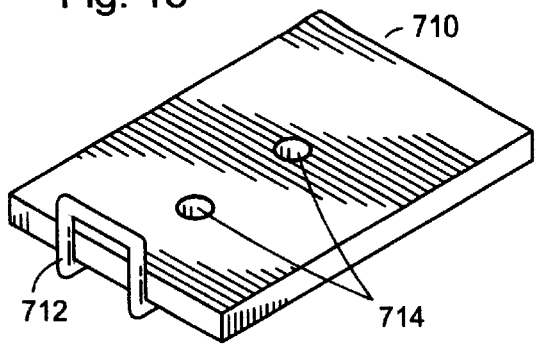
FIG. 15 discloses a perspective view of the second shim plate

FIGS. 14 and 15 disclose the two shim plates utilized in connection with the modified embodiment of this invention. Shown in FIG. 14 is one of the two identical shim plates inserted between the crane's boom and the side panels 534, 536 of the rectangular portion 504. Each plate 700 is 10¼" wide by 15" long by ½" thick. A handle 702 is formed from a ½" solid round bar and is welded to the end of shim plate 700. This handle is 5¼" across the top and 3¾" high. Additionally, shim plate 700 includes two apertures to accommodate a ⅝" bolt, with the two apertures being spaced from one another a distance of 9⅜.

Figure 16:
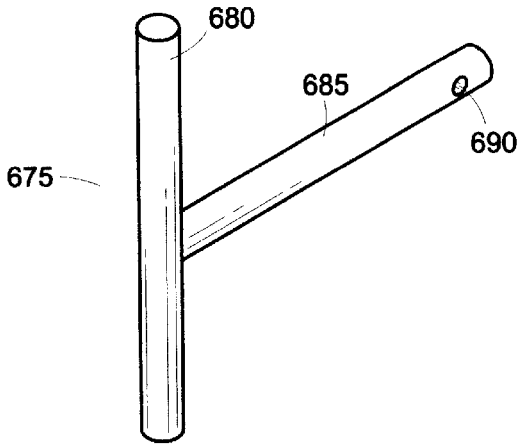
FIG. 16 discloses a perspective view of the second connect pin.

FIG. 15 discloses one of the two identical shim plates 710 which are inserted between the crane boom terminal end and the top and bottom panels 530, 532 of the rectangular portion 504. The width of each of these shim plates 710 is 8¼", the length is 20", and the thickness is ½". Once again, a ½" solid round handle is welded to one end of the shim plate with the handle 712 having a width of 5¼" and a height of 3¾". Two apertures 714 are spaced 13⅜" apart and are drilled to accommodate a ⅝" bolt. In actual use, once the shim plates are inserted between the crane's boom and the rectangular portion 504 bolts are inserted through the top/bottom panel apertures 544 and the side panel apertures 546 into apertures 714, 704, respectively. Additionally, the second connect pin 675 shown in FIG. 16 is inserted through the rectangular portion aperture 556 with the second connect pin having a handle portion 680, an insert portion 685, and an aperture 690. A pin of the type well known in the trade can be passed through the aperture 690 to in effect lock the second connect pin in position. The handle portion 680 is 6" in length, and the insert portion 685 is 12" in length. The aperture 690 has a diameter of ⅛" and is located 1" from the free end of the insert portion 685. The handle is fabricated from ¾" solid round while the insert portion 685 is fabricated from 1" solid round with the insert portion 685 being welded or otherwise fixedly secured to the handle portion 680. This second connect pin further effects the securing of the crane to the first boom extension segment 270.

With the system of this invention, a drive test can be done immediately, without the necessity of obtaining a permit. Thus the truck is not limited to travel only during daylight hours or on certain days of the week. Additionally, a second truck is not needed. Still further, additional counter weights are not needed. Thus, an additional worker is not required.

It should be kept in mind that the crane extension system of this invention is not limited to usages involving just radio frequency transmissions, but can also be used to simulate a tower for the attachment thereto of a camera or some other type of transmission and reception devices.

Additionally, for purposes of testing, in a highly populated area with a lot of buildings, trees, etc. cranes equipped with the system of this invention could be erected at the corner of an intersection such that a directional signal could be emitted down one roadway, received by a receiver atop another crane utilizing this inventive system and then transmitted again down a second road in order to conduct urban tests. In fact drive tests using the system of this invention have been conducted at heights ranging from 30' to 200'.

In actual use, a 30 ton crane using the system of this invention can reach heights of 200', while a 30 ton crane not using the invention can only reach about 166'. Similarly, a 23.5 ton crane using the system of this invention can reach heights of 180', while a 23.5 ton crane not using the invention can only reach about 147'.

Also with respect to testing, by mounting the basket on top of the boom, the system is able to avoid any shadowing by the boom or the equipment. Otherwise, with systems associated with the prior art it can be necessary to rotate the boom azimuth two-thirds of the way through a drive test.

Furthermore, it can be appreciated that a truck equipped with this invention, while initially 8' wide, with outriggers extended in an operative position requires about 21' in width. Meanwhile, the prior art with its 10' wide trucks, with outriggers extended in an operative position typically require somewhere between 30–40' in width. Thus the invention enables a crane to be extended to the same working height of cranes weighing twice as much and being twice as side when in the operative position. Experienced operators can set up the entire system and extend the boom and the boom extension segments in about twenty minutes, and perform tear down in under twenty minutes. Thus, total non-emitting time associated with a typical drive test is under forty-five minutes.

While the crane extension system herein described constitutes the preferred embodiment of the invention, it is to be understood that the invention is not limited to this precise form of crane extension system and that changes may be made therein without departing from the scope of the invention which is defined in the appended claims.

What is claimed is:

1. A crane extension system for use with a crane having a boom with a distal end, said system comprising a mounting plate, a mounting platform attached to said mounting plate, said mounting platform having a mounting platform base, a mounting bracket, and an adjustable bracket portion, said adjustable bracket portion being secured to an opposite end of said mounting platform base from said mounting bracket, and a mounting basket, said mounting basket having a base portion, a railing located a first distance above said base portion, and at least one post secured to and extending vertically above said railing, said base portion having a lower surface, said base portion lower surface having secured adjacent thereto a mounting bracket receptacle, said mounting bracket being placed into said mounting bracket receptacle, said base portion also being secured to said adjustable bracket portion.

2. The system according to claim 1, wherein said mounting plate is securable to the distal end of a crane boom.

3. The system according to claim 1, wherein said adjustable bracket portion comprises a bracket base, a pair of threaded rods passing through said bracket base, fasteners securing the position of said bracket base on said threaded rods, and an engagement portion, said engagement portion contacting and providing for attachment of said mounting platform to said mounting basket.

4. The system according to claim 1, which includes a first boom extension segment and a second boom extension segment, said first boom extension segment being securable to the distal end of the boom of a crane, said second boom extension segment being secured to said first boom extension segment.

5. The system according to claim 4, wherein said first boom extension segment comprises a cylindrical portion and a rectangular portion, said rectangular portion being securable to the distal end of a crane boom, said cylindrical portion having one end inserted into and secured to said rectangular portion.

6. The system according to claim 5, wherein said rectangular portion has a plurality of reinforcing straps wrapped around said rectangular portion.

7. The system according to claim 5, wherein said first boom extension has a plurality of handles attached thereto.

8. The system according to claim 4, wherein said first boom extension is securable in place adjacent the distal end of a crane boom by a plurality of shim plates.

9. The system according to claim 4, wherein said mounting plate is secured to said second boom extension.

10. The system according to claim 1, wherein said mounting bracket receptacle has a cross bar secured to said base portion lower surface, and receptacle plates secured to said cross bar.

11. The system according to claim 1, wherein the mounting basket has a base surface on said base potion, and said railing having an intermediate railing, and a side rail, said intermediate railing located above said base surface but below said side rail.

12. A crane extension system for use with a crane having a boom with a distal end, said system comprising a mounting plate securable to the distal end of a crane boom, a mounting platform attached to said mounting plate, said mounting platform having a mounting platform base, a mounting bracket, and an adjustable bracket portion, said adjustable bracket portion being secured to an opposite end of said mounting platform base from said mounting bracket, said adjustable bracket portion comprising a bracket base, a pair of threaded rods passing through said bracket base, fasteners securing the position of said bracket base on said threaded rods, and an engagement portion, and a mounting basket, said mounting basket having a base portion, a railing located a first distance above said base portion, and at least one post secured to and extending vertically above said railing, said base portion having a lower surface, said base portion lower surface having secured adjacent thereto a mounting bracket receptacle, said mounting bracket being placed into said mounting bracket receptacle, said base portion also being secured to said adjustable bracket portion, said engagement portion contacting and providing for attachment of said mounting platform to said mounting basket.

13. The system according to claim 12, wherein said mounting bracket receptacle has a cross bar secured to said base portion lower surface, and receptacle plates secured to said cross bar.

14. The system according to claim 12, wherein the mounting basket has a base surface on said base portion, and said railing having an intermediate railing, and a side rail, said intermediate railing located above said base surface but below said side rail.

15. A crane extension system for use with a crane having a boom with a distal end, said system comprising a mounting plate, a mounting platform attached to said mounting plate, said mounting platform having a mounting platform base, a mounting bracket, and an adjustable bracket portion, said adjustable bracket portion being secured to the opposite end of said mounting platform base from said mounting bracket, a mounting basket, said mounting basket having a base portion, a railing located a first distance above said base portion, and at least one post secured to and extending vertically above said railing, said base portion having a lower surface, said base portion lower surface having secured adjacent thereto a mounting bracket receptacle, said mounting bracket being placed into said mounting bracket receptacle, said base portion also being secured to said adjustable bracket portion, a first boom extension segment, said first boom extension segment able to be secured to the distal end of the boom of a crane, and a second boom extension segment, said second boom extension segment being secured to said first boom extension segment, said mounting plate secured to said second boom extension.

16. The system according to claim 15, wherein said first boom extension segment comprises a cylindrical portion and a rectangular portion, said rectangular portion able to be secured to the distal end of a crane boom, said cylindrical portion having one end inserted into and secured to said rectangular portion, said rectangular portion having a plurality of reinforcing straps wrapped around said rectangular portion.

17. The system according to claim 15, wherein said first boom extension has a plurality of handles attached thereto.

* * * * *